US005784912A

United States Patent [19]

Focken et al.

[11] Patent Number: 5,784,912

[45] Date of Patent: Jul. 28, 1998

[54] TANGENTIAL ROLLING HEAD

[75] Inventors: Andreas Focken, Schwarzenbek; Klaus Oppelt, Lauenburg, both of Germany

[73] Assignee: Wilhelm Fette GmbH, Schwarzenbek, Germany

[21] Appl. No.: 870,885

[22] Filed: Jun. 6, 1997

[30] Foreign Application Priority Data

Jun. 7, 1996 [DE] Germany ..... 296 10 183.4

[51] Int. Cl.[6] ..... B21H 03/04

[52] U.S. Cl. ..... 72/104; 72/108

[58] Field of Search ..... 72/104, 108

[56] References Cited

U.S. PATENT DOCUMENTS 2,933,955 4/1960 Laemmel ..... 72/104
3,913,365 10/1975 Kruse ..... 72/104

FOREIGN PATENT DOCUMENTS 29 44 999 11/1982 Germany .
G-81 26 319 5/1983 Germany .

*Primary Examiner*—Lowell A. Larson
*Attorney, Agent, or Firm*—Vidas, Arrett & Steinkraus, P.A.

[57] ABSTRACT

The invention relates to a tangential thread rolling head with two fork-shaped rolling head arms in which thread rollers are rotatably mounted by way of parallel axles. The thread rollers are in engagement with a pinion, sitting on the axles, of a gear coupling both thread rollers, and the thread rollers and pinion are formed such that the rollers are laterally insertable before installing the axles. There is also a rolling head holder on which the rolling head arms are pivotably mountable about a common axle running parallel to the roller axles, threaded means for adjusting the distance of the thread roller axles from one another and adjusting means for the pivotal position of the rolling head to the rolling head holder. Cooperating claws of the thread roller and pinion are formed such that the roller may only be laterally inserted in a single defined rotational position.

16 Claims, 3 Drawing Sheets

TANGENTIAL ROLLING HEAD

BACKGROUND OF THE INVENTION

The invention relates to a tangential rolling head.

For the manufacture of threads, tangential rolling heads in which thread rollers are rotatably mounted on two fork-type rolling head arms are generally known. With the manufacture of a thread by way of cold forming, the thread rolling head, with the non-driven thread rollers, is driven from the side onto the rotating work piece, so that the rotational movement of the work piece is transmitted onto the thread rollers. The pitch of the thread to be manufactured results from the pitch of the thread of the thread rollers. The thread rollers must, at the beginning of the thread rolling procedure and also during the rolling of the thread, be at a particular position to one another. Otherwise, it is not guaranteed that the threads of the one thread roller engage into the threads produced on the work piece by the other thread roller.

In order to take account of this mentioned requirement, it is known with tangential rolling heads to provide a synchronous gearing between the thread rollers. From the company sheet "Wagner Seitenrollwerkzeuge" of Gustav Wagner Maschinenfabrik, it is known to also rotatably mount a pinion on the axle on which the thread roller is rotatably mounted. The pinion comprises on its end face a pair of claws lying diametrically opposite one another which become engaged with complementary claws of the thread roller, in order to transmit a rotational movement of the pinion onto the thread roller. The assembly of the thread rollers, which should be exchangeable, is effected from the free end by way of a lateral insertion, wherein the claws must be aligned to one another. Furthermore, the holes of the thread roller and the pinion must be aligned to one another so that the axle can be interspersed. This assembly thus requires some skill and incurs some effort. Since for the rotational position of the thread roller, there can be assembled two rotational positions, the fitter must take care that the thread roller is assembled in the correct rotational position.

It is known from DE 29 44 999 and DEG 81 26 319 not to couple the thread rollers via a gearing, but rather to provide for free rotation, wherein however means are provided in order that the thread rollers are brought back to an initial position after the machining process. The present invention is however concerned with a tangential rolling head whose thread rollers are coupled via a gearing.

BRIEF SUMMARY OF THE INVENTION

It is the object of the invention to provide a tangential thread rolling head with which the assembly of the thread rollers is simplified and the danger of assembly in a wrong rotational position is avoided.

This object is achieved by those features of claim 1 namely, a tangential thread rolling head with two fork-shaped rolling head arms in which thread rollers are rotatably mounted by way of parallel axles, wherein said thread rollers are in engagement with a pinion, sitting on said axles, of a gear which couples both rethread rollers, and said thread rollers and pinion are formed such that said rollers are laterally insertable before installing said axles, a rolling head holder on which said rolling head arms are pivotably mountable about a common axle running parallel to said roller axles, threaded mans for adjusting the distance of said thread roller axles from one another and adjusting means for the pivotal position of said rolling head to said rolling head holder, wherein cooperating claws of said thread roller may only be laterally formed such that said roller may only be laterally inserted in a single defined rotational position.

With the tangential thread rolling head according to the invention, the cooperating claws are formed by the thread roller and the pinion such that the roller may only be inserted laterally in a single defined rotational position. According to one form of the invention, this is realized in that the ends of a pair of claws lying opposite one another each lie at the side of an acute angle, wherein the claws of the pinion are complementarily designed such that the angle formed by them diverges outwardly. By way of such a design of the thread roller and pinion, with a pinion already assembled, a lateral insertion into the arm of the rolling head is only possible at a single rotational position of the thread roller. Any other position would block the insertion.

According to a further form of the invention, the claws at the ends are formed at an angle such that the axles of the pinion and the thread roller coincide when the claws are completely laterally inserted. The conical design of the ends of the claws of the pinion and the thread roller not only ensure the rotational position but also the end position. After the complete insertion of the thread roller, a simultaneous alignment of the holes of the thread roller and the pinion is therefore guaranteed, so that immediately the axle can be guided through without problem.

The rolling head arms are pivotably mounted about a common axle on the rolling head holder. Moreover, there is provided an adjusting mechanism in order to be able to adjust the distance of the thread roller axles from one another according to the diameter of the thread to be formed. From the mentioned documents, for example DE-G-81 26 319, it is known to arrange, in each case, an adjusting screw in the arm, facing the holder, of the two-armed lever of the rolling head arm, wherein the ends, facing one another, of the adjusting screw, lie against one another. By turning both adjusting screws the thread roller distance may be adjusted. If the change is finally adjusted, whereby it is known to insert a gauge between the thread rollers for measuring the distance, with the help of a further adjusting screw, the fixing of the distance taken up is effected. Such an adjusting mechanism has some disadvantages. One consists in that an operation must be effected from two different sides. With cramped space conditions, for example on a turret head of a machine tool, this may lead to difficulties. The mounting of the adjusting screws requires space. Therefore the length of the rolling head is enlarged by the arrangement of the adjusting screws. In CNC turret lathes there is often little space since the turret head only has a relatively small swing circle diameter.

Therefore a further form of the invention provides for a single adjusting screw in a rolling head arm to cooperate with a fixed jaw of the other rolling head arm for adjusting the distance of the thread rollers. The single screw may be arranged in a space saving manner such that the total length of the thread rolling head may be considerably reduced compared with conventional designs. In this context a further form of the invention provides for the adjusting screw to be arranged roughly at the height of the common axle, this being inclined to a middle plane which extends between the rolling head arms through the common axle of the rolling head arms. The jaw connected to the other rolling head arm extends beyond the middle plane in the direction of the adjusting screw. In this manner a particularly short rolling head is achieved.

As mentioned, the exact adjustment of the axle distance of the thread rollers requires a precise measurement. In this context, one form of the invention provides for measuring points, preferably measuring balls, to be arranged on the outer side of the rolling head arms for determining the axle distance of the the thread rollers. With conventional tangential rolling heads, for each thread an individual gauge is applied. This increases the effort for the operator. With the solution according to the invention, a single conventional measuring instrument may be employed, for example a micrometer screw or likewise in order to precisely determine the distance of the thread rollers. A specific adjusting gauge may be done away with.

With the forming of a thread, considerable forces arise which may lead to the bending of the axle of the thread rollers, which may cause the fracture of the pinion. With known tangential rolling heads, is has therefore also been provided to form the steel axles eccentrically in order to compensate for a deformation. In this respect, on form of the invention provides for the axles for the thread rollers to be formed from a hard metal. Hard metal reduces the deformation drastically and thus prevents fracture of the pinion. Moreover the running characteristics of the thread roller and the axle are improved.

If the adjustment of the axle distance of the thread rollers in the previously described way and manner is effected for the adjustment to another thread, there results a different position of the thread rollers to the middle plane going through the common axle of the rolling head arms. It is therefore necessary that after adjusting the axle difference, the centricity is again restored. In this context, one form of the invention provides for at least one rolling head arm to be designed as a double-armed lever and for a projection to be provided on the arm assigned to the holder, this projection cooperating with an adjusting mechanism for adjusting the projection on the holder. For realizing this concept, according to a further form of the invention the projection may cooperate with a nut which sits on a threaded spindle and which is rotationally fixedly guided. The mounting of the threaded spindle in the holder, with a turning of the threaded spindle, leads to a linear adjustment of the nut on the threaded spindle and thus to a pivoting of the assigned rolling head arm. Since the rolling head arms, as is known per se, are pretensioned to one another via at least one spring, the pivoting of the one rolling arm leads to the copivoting of the other arm. In this way, the rolling head may be aligned with respect to the middle plane. The spindle, according to a further embodiment of the invention, is preferably accessible from both ends so that the operating person can find the respective better end in order to accomplish the center adjustment.

Knocks on switching on the turret head of the machine tool may lead to a fracture of the projection or also of the spindle. In order to counteract this danger, according to a further form of the invention it is provided for the spindle to be impinged at opposite ends with a compression spring.

According to a further form of the invention it is provided for the adjusting mechanism to be mounted symmetrically on the holder. In this way the rolling head on the holder can be assembled turned about 180° without having to reconstruct the adjusting mechanism.

According to a further form of the invention it is provided, for the rolling head arm, that a scale is mounted on one arm of the two-armed lever, the scale cooperating with a marking on the common axle. With the help of such a scale the axle distance of the thread roller may be coursely adjusted.

According to a further form of the invention between the holder and a rolling head arm, a further scale is mounted for indicating the center position of the rolling head for the adjusted axle distance of the thread rollers in each case. To each thread size there is to be a particular size on the scale so that the centricity may be preset with the help of the mentioned scale.

BRIEF DESCRIPTION OF THE DRAWINGS

The invention is hereinafter explained in more detail by way of drawings.

DETAILED DESCRIPTION OF THE INVENTION

Figure 1:
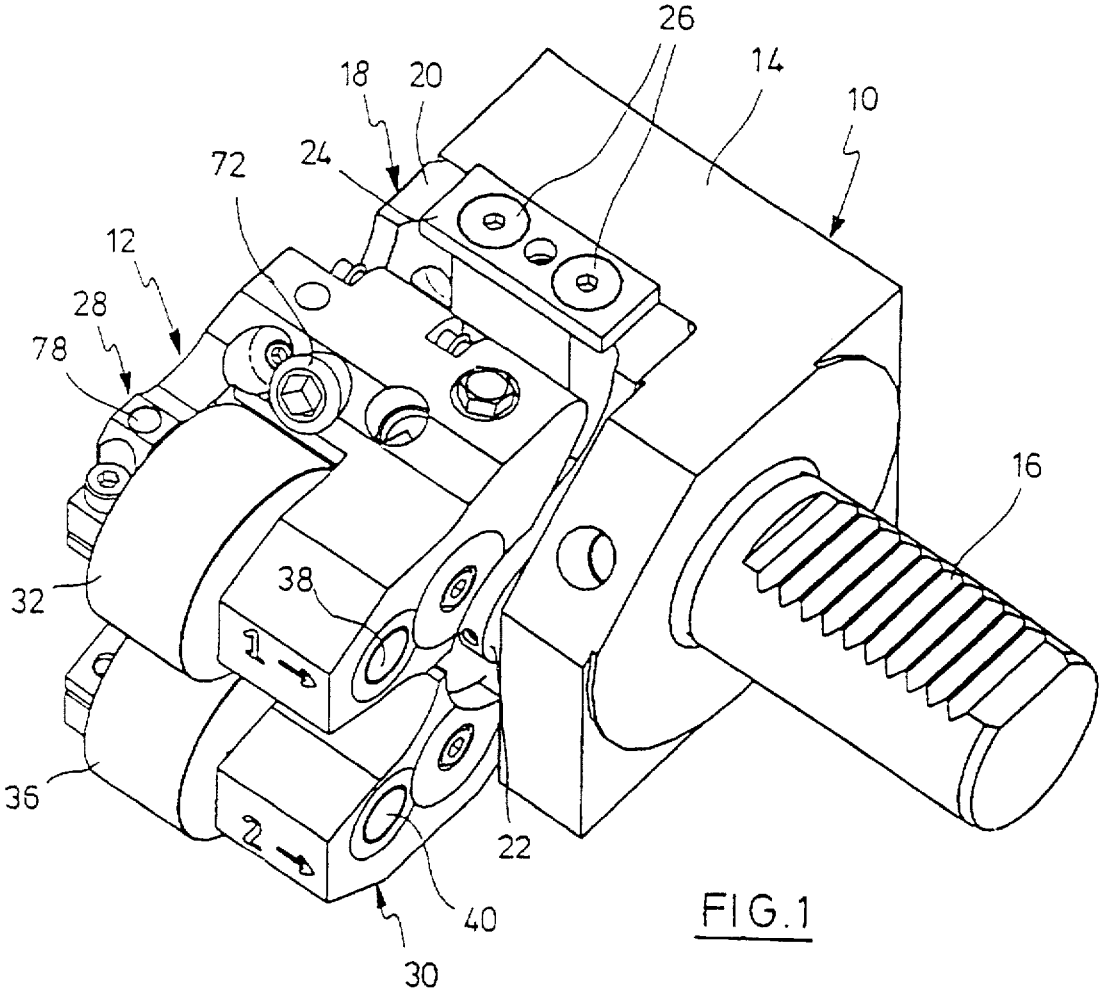
FIG. 1 shows perspectively a tangential thread rolling head according to the invention.

In FIG. 1 there is shown a clamping body 10, for the thread rolling head 12 said clamping body comprising an L-shaped section 14 at whose one web on the outer side there is mounted a clamping spigot 16. In the rectangular recess of the L-shaped section 14 a rolling head holder 18 is mounted. This consists of a plate-shaped part 20 and two fork arms of which only on can be recognized at 22. The plate-shaped section 20 is fastened, sitting on the clamping body 10, onto a shown relief of the L-shaped section 14.

The rolling head 12 comprises two fork-shaped rolling head arms 28, 30 which is formed as a two-armed lever and which are rotatably mounted about a common axle by two arms 22 of the holder (for this see the further figures). Between the fork arms 28, 30 there are rotatably mounted thread rollers 32, 36, this being on an axle 38 or 40 of hard metal. As can be recognized the right fork arm in FIG. 1 is wider than the left. This is because a toothed gearing is mounted in the wider fork arm, wherein of the gearing, a middle toothed wheel which couples both thread rollers 32, 36 with one another, is arranged on the common axle. In each case a pinion (not shown) of the gearing sits on the axle 38, 40 and cooperates with the thread roller 32, 36 in a rotationally fixed manner.

Figure 2:
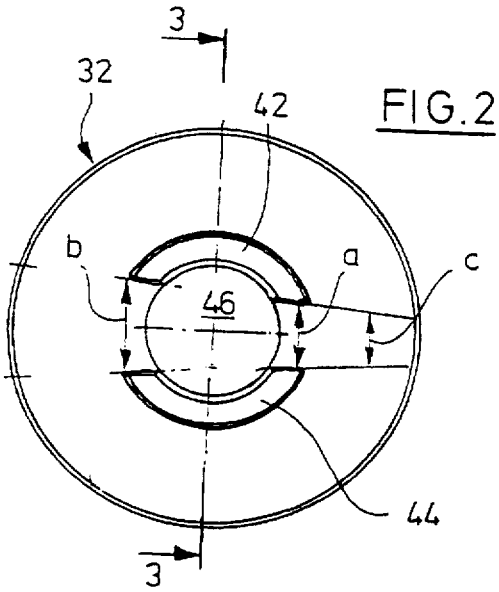
FIG. 2 shows a lateral view of a thread roller of the rolling head according to FIG. 1.
Figure 3:
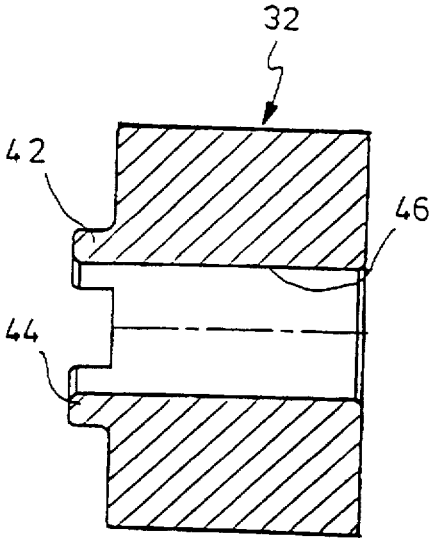
FIG. 3 shows a section through the representation according to FIG. 2 along the line 3—3.

FIG. 2 for example shows a lateral view of the thread roller 32. It can be recognized that on the end face there are provided two arc-segment-shaped claws which on both sides lie opposite a continuous hole 46. Although the arc length of the claws 42, 44 is the same, the claws are displaced relative to one another in the circumferential direction so that on the one side a distance a and on the other side a distance b between the ends of the oppositely lying claws 42, 44 are formed. The ends are formed such that they lie on the sides of an angle c. The claws of the pinion, which is not shown, on the axles 28, 40 are complementarily formed. By way of a lateral insertion of the rollers 32, 36, these may be fitted into the arms 28, 30, wherein only a single rotational position of the thread rollers 32, 36 permit this installation.

A position rotated about 180° would lead for example to the narrower distance a abutting against the narrower distance of the claws of the pinion. Only with an opposite rotational position of the rollers can the claws be guided into one another. Moreover the claws are formed such that with a snug fit of the ends of the cooperating claws, the holes 46 of the rollers 32, 36 are aligned with the holes of the installed pinion so that the axles 38, 40 may be inserted without further ado after the insertion of the rollers 32, 36. An exact alignment of the rollers for this purpose is no longer necessary.

Figure 4:
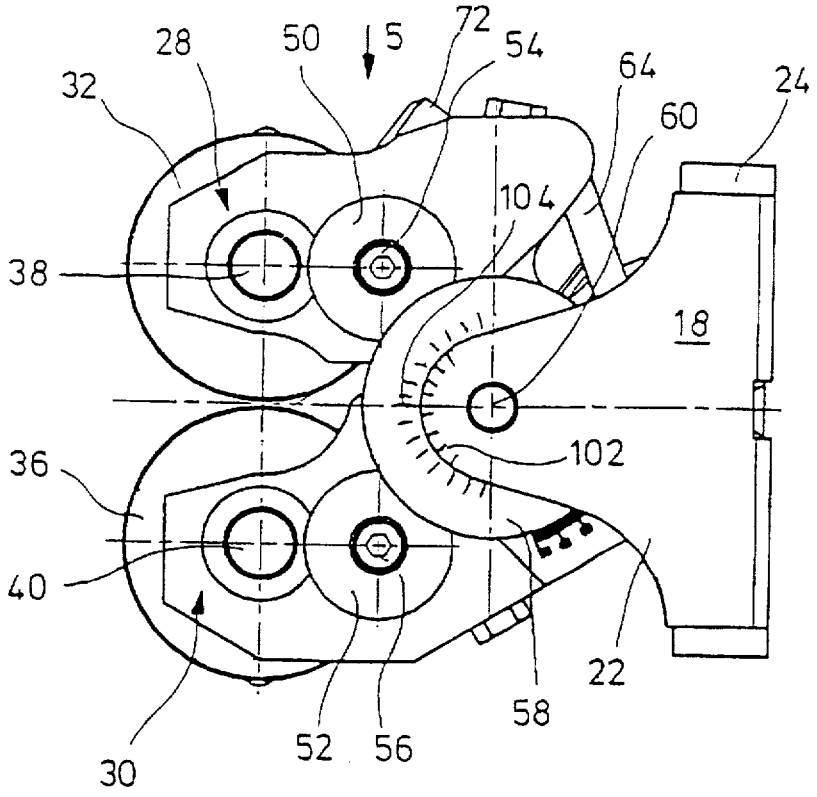
FIG. 4 shows a lateral view of the thread rolling head according to FIG. 1, without a clamping body.
Figure 5:
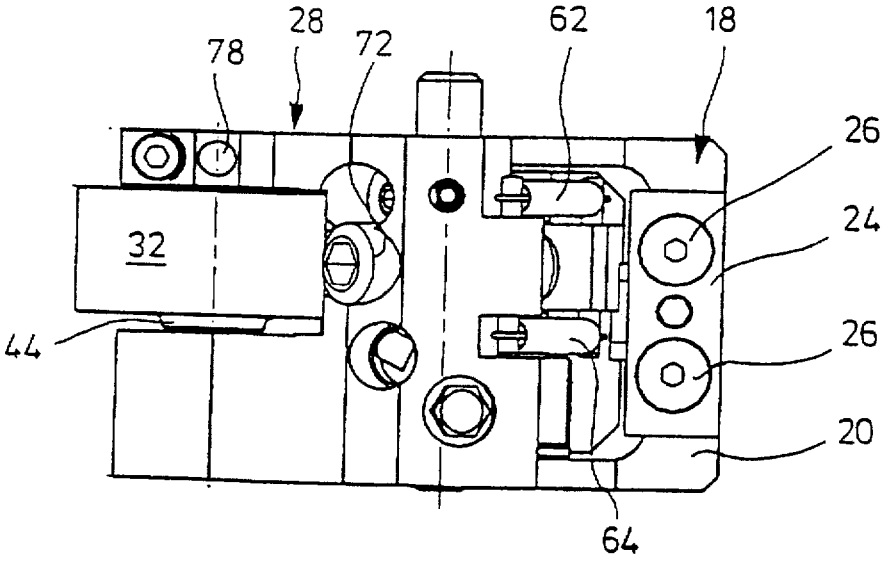
FIG. 5 shows a plan view of the representation according to FIG. 4 along the directional arrow 5.

In FIGS. 4 and 5 there can be recognised a lateral view of the tangential rolling head disassembled from the clamping body 10. The discs 50, 52 mount axles 54, 56 of the gearwheels of the gearing, these gearwheels camming with the pinions on the axles 38, 40. The disc 58 mounts the common axle 60 about which the arms 28, 30 are pivotable on the holder 18. Moreover behind this, there is located either a single large gearwheel or an arrangement of three gearwheels, wherein the middle one sits on the axle 60. In this case, an engagement with the gearwheels on the axles 54, 56 takes place so that the rotation of the thread rollers 32, 36 is coupled.

Figure 6:
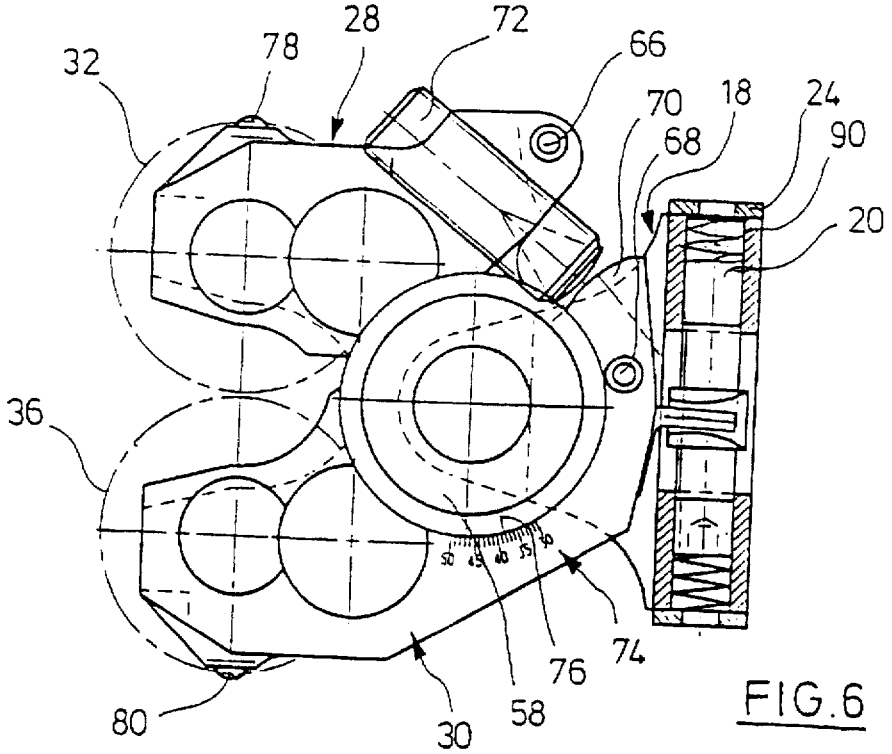
FIG. 6 shows a similar representation to FIG. 4, but with the omission of one arm of the fork-like rolling head holder and with a section through an adjusting means for the pivoting of the rolling head.
Figure 7:
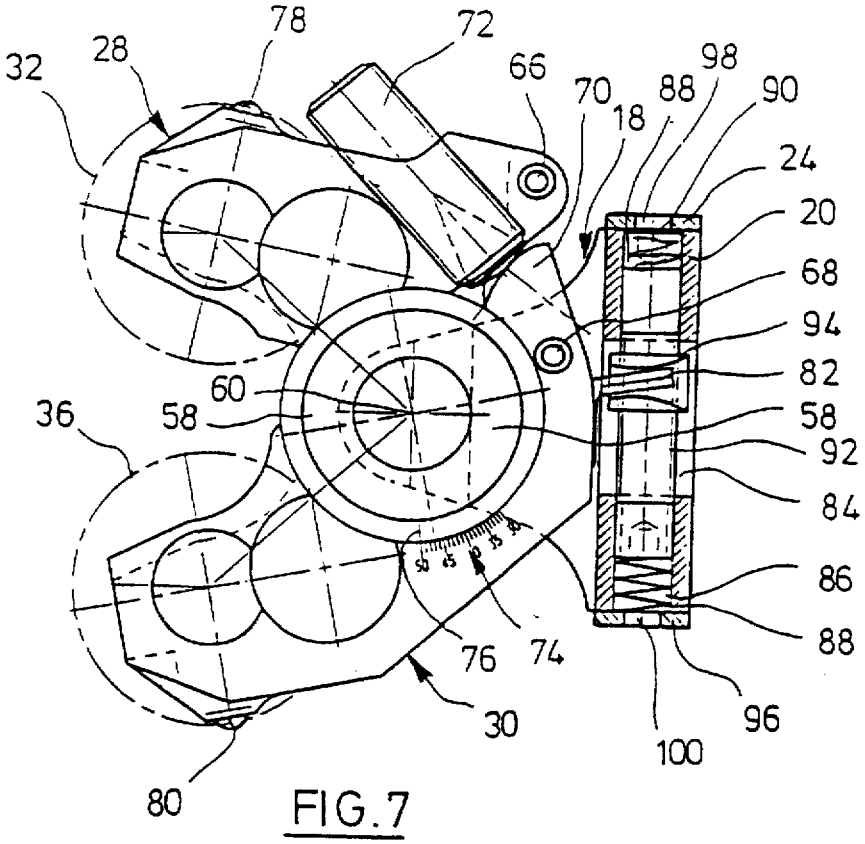
FIG. 7 shows a similar representation to FIG. 6, but with a different pivoting position of the rolling head arms.

Two springs 62, 64 are tensioned between the arms, facing the holder, of the rolling head arms 28, 30, these springs tensioning the corresponding arms towards one another. In FIGS. 6 and 7 the corresponding holes 66, 68 with which the springs 62, 64 cooperate can be recognized.

In FIGS. 6 and 7 it can further be recognised that the arms 28, 30 are not constructed the same, but rather the rolling head arm 28 is relatively short, whereas the other rolling head arm 30 comprises a jaw section 70 extending to the short section. The jaw section 70 extends beyond the middle plane which extends between the rollers 32, 36 through the common axle 60. Above the common axle 60 inclined to the described center axle there is mounted an adjusting screw 72 in the upper rolling head arm 28 in a corresponding threaded hole. By turning the screw 32, the arms 28, 30 may be pivoted relative to one another about a common axle 60, as is shown from the various positions in FIGS. 6 and 7. By way of this, the distance of the rollers which are only shown dot-dashed in FIGS. 6 and 7, may be adjusted. On the lower arm 30 there is provided a scale 74 which cooperates with a marking 76 on the plate 58 which is rigidly attached to the axle 60 and is attached to the arm 28, so that the marking indicates on the scale what distance the axles of the rollers 32, 36 have from one another. This adjustment however is relatively course. A fine adjustment is effected with the help of measuring balls 78, 80 on the outer side of the arms 28, 30, the distance of which is measured by a suitable precision measuring instrument.

To the jaw section 70 there is connected a spring section 82 which is guided in a holding section 20 by way of a slit 84 in the holding section. The holding section comprises ahole 86 which mounts a threaded spindle 88. The threaded spindle is impinged by a compression spring on the one side at 88 and on the opposite side at 90. The threaded spindle 88 comprises a threaded section 92 on which sits a nut-like slide 94 with which the projection 82 cooperates. The slide 94 is guided through the slit 84 in a rotationally fixed manner so that on rotation of the spindle 88 in FIGS. 6 and 7, it moves downwards or upwards. With the help of this adjusting mechanism the lower arm 30 may be pivoted in the desired manner. Since the arms 28, 30 are tensioned with one another via springs, also at the same time the upper arm 28 is copivoted. By these means it is possible to achieve a center position of the rolling head, after, as is for example shown in FIG. 7 the thread rollers 32, 36 have assumed a predetermined distance from one another.

The section 20 is covered by a plate 24 at the upper side, this plate being fastened with screws 26. A further plate 96 is located on the lower side and is fastened in the same manner. Both plates 24, 96 comprise an opening 98, 100 for guiding through a tool for turning the spindle 88.

As can be recognised from FIG. 4, the arm 22 of the holder 18 comprises a scale 102 which cooperates with a scale 104 on the disc 58. The disc 58 moves together with the arm 28 so that with the help of the scale 102 the center adjustment of the rolling head can be set. For each scale graduation there is a defined axial distance of the thread rollers. If this for example is 36, then the graduations of both scales 102, 104 marked with 36 must be aligned to one another so that a center adjustment is present.

It is clear that also on the oppositely lying sides of the rolling head scales may be provided corresponding to the scales 74 or 102 and 104.

We claim:

1. A tangential thread rolling head with two fork-shaped rolling head arms in which thread rollers are rotatably mounted by way of parallel axles, wherein said thread rollers are in engagement with a pinion, sitting on said axles, of a gear which couples both thread rollers, and said thread rollers and pinion are formed such that said rollers are laterally insertable before installing said axles, a rolling head holder on which said rolling head arms are pivotably mountable about a common axle running parallel to said roller axles, threaded means for adjusting the distance of said thread roller axles from one another and adjusting means for the pivotal position of said rolling head to said rolling head holder, wherein cooperating claws of said thread roller and pinion are formed such that said roller may only be laterally inserted in a single defined rotational position.

2. A thread rolling head according to claim 1, wherein the ends of said claws of a pair of claws, lying opposite one another on said thread roller, each lie on the side of an acute angle, said claws of the pinion being formed complementarily such that said angle formed by said pinion diverges outwardly.

3. A thread rolling head according to claim 2, wherein said claws are formed such that said axles of the pinion and thread roller coincide when said claws are completely laterally inserted into one another.

4. A thread rolling head according to claim 1, wherein a single adjusting screw in a rolling head arm cooperates with a fixed jaw of said other rolling head arm for adjusting the distance of said thread rollers from one another.

5. A thread rolling head according to claim 4, wherein said adjusting screw, arranged roughly at the height of said common axle of said rolling head arms, extends inclined to a middle plane extending between said rolling head arms and said common axle and said fixed jaw extends beyond said middle plane in the direction towards the assigned end of said adjusting screw.

6. A thread rolling head according to claim 1, wherein on the outer side of said rolling head arm there are arranged measuring points, preferably measuring balls, for determining the axle distance of said thread rollers.

7. A thread rolling head according to claim 1, wherein both axles for said thread rollers are formed from hard metal.

8. A thread rolling head according to claim 1, wherein at least one rolling head arm is formed as a double-armed lever and on said arm assigned to said holder there is provided a projection which cooperates with an adjusting mechanism for adjusting said projection on said holder.

9. A thread rolling head according to claim 8, wherein said projection cooperates with a nut which sits on a threaded spindle and is guided in a rotationally fixed manner.

10. A thread rolling head according to claim 9, wherein said spindle is rotatably but axially fixedly arranged in a hole of said holder.

11. A thread rolling head according to claim 9 wherein said spindle at opposing ends is impinged by a compression spring.

12. A thread rolling head according to claim 9, wherein said spindle is accessible from both ends.

13. A thread rolling head according to claim 9, wherein said adjusting mechanism is mounted symmetrically on said holder.

14. A thread rolling head according to claim 8, wherein said projection is formed from a spring piece which is mounted on said assigned arm.

15. A thread rolling head according to claim 1, wherein at one end of said common axle of said rolling head arms there is mounted a scale for indicating the axle distance of said thread rollers.

16. A thread rolling head according to claim 1, wherein on said holder and a rolling head arm there is each mounted a scale for indicating the center position of said rolling head for the adjusted axle distance of said thread rollers in each case.

* * * * *